US007009632B2

(12) United States Patent
Sawyer

(10) Patent No.: US 7,009,632 B2
(45) Date of Patent: Mar. 7, 2006

(54) INTERNAL CD/DVD LABEL PRINTER AND ELECTRONIC INK

(75) Inventor: Michael D. Sawyer, Sioux City, IA (US)

(73) Assignee: Gateway Inc., Irvine, CA (US)

( * ) Notice: Subject to any disclaimer, the term of this patent is extended or adjusted under 35 U.S.C. 154(b) by 221 days.

(21) Appl. No.: 10/646,161

(22) Filed: Aug. 22, 2003

(65) Prior Publication Data

US 2005/0041091 A1 Feb. 24, 2005

(51) Int. Cl.
*B41J 2/435* (2006.01)

(52) U.S. Cl. ..... 347/224

(58) Field of Classification Search ..... 347/4, 347/224, 225, 247, 251; 369/44.39, 75.11–77.11, 369/224–225

See application file for complete search history.

(56) References Cited

U.S. PATENT DOCUMENTS

| | | | | |
|---|---|---|---|---|
| 5,745,102 A | | 4/1998 | Bloch et al. | 345/530 |
| 6,074,031 A | * | 6/2000 | Kahle | 347/4 |
| 6,148,722 A | | 11/2000 | Hagstrom | 101/35 |
| 6,202,550 B1 | | 3/2001 | Lee et al. | 101/38.1 |
| 6,270,177 B1 | | 8/2001 | King et al. | 347/2 |
| 6,312,174 B1 | | 11/2001 | Drynkin et al. | 400/120.16 |
| 6,409,401 B1 | | 6/2002 | Petteruti et al. | 400/88 |
| 6,474,882 B1 | | 11/2002 | Vaghi | 400/490 |
| 6,778,205 B1 | * | 8/2004 | Anderson et al. | 347/251 |
| 2002/0122378 A1 | | 9/2002 | Masahiro | 369/273 |
| 2003/0133005 A1 | * | 7/2003 | Bronson | 347/247 |

FOREIGN PATENT DOCUMENTS

| | | |
|---|---|---|
| EP | 2000105336 | 10/2001 |
| EP | 1 157 845 A1 | 11/2001 |
| EP | 1 332 884 A2 | 8/2003 |
| WO | WO 00/36560 | 6/2000 |
| WO | WO 02/063602 A1 | 7/2002 |
| WO | WO 02/071382 A1 | 9/2002 |

* cited by examiner

*Primary Examiner*—Hai Pham
(74) *Attorney, Agent, or Firm*—Jeffrey A. Proehl; Woods, Fuller, Shultz & Smith

(57) ABSTRACT

A drive is capable of printing a label on a unit of optical media. The drive includes a first head optically communicating with the media on a first side and a second label printing head for applying a visual label associated with the unit of optical media on a second side while the media is in an operational position. The first head includes an optical read-only head or read-write head. The second label printing head includes a fixed or movable print head, thermal, ink jet, or laser print head. The second head can communicate through electrical contacts or a wireless interface with a circular film having addressable elements capable of being addressed and providing a visual display via liquid crystal elements.

21 Claims, 12 Drawing Sheets

INTERNAL CD/DVD LABEL PRINTER AND ELECTRONIC INK

FIELD OF THE INVENTION

The present invention generally relates to the field of computer peripherals, and the like, and particularly to a printer mechanism for use in printing removable media while within a removable media drive.

BACKGROUND OF THE INVENTION

The usefulness of labels is self-evident. For removable media such as CD/DVD, optical media, and other media such as floppy discs, VHS tapes, and the like, labeling identifies the contents of the media or alternatively may contain a date of recording, a coded index related to the contents, or the like. Computers, with their attendant large quantities of information processing capabilities including the relatively recent addition of CD/DVD "burning" capabilities, may benefit from labeling capabilities for removable storage. It is well known that computer users possess the capability through specially adapted software designed to print labels for their CDs and DVDs using conventional laser and ink jet printers. In some cases users may possess the capability to print directly onto the disc itself using a variety of methods and arrangements. In U.S. Pat. No. 6,202,550, B1 issued on Mar. 20, 2001 to Lee et al, a printer is described using ink jet or laser print heads arranged orthogonally to print annular indicia on the surface of a compact disc. It should be noted that in the system of Lee et al, the print heads rotate while the disk remains stationary. Thermal printing systems are described in U.S. Pat. No. 6,312,174 B1 issued on Nov. 16, 2001 to Drynkin et al, and U.S. Pat. No. 6,148,722 issued Nov. 21, 2000 to Hagstrom. While these printing systems allow for printing directly onto a CD or DVD, none are convenient for the user in that the disc must be removed from use and inserted into a separate device apart from the drive particularly given that rotation speeds required for reading and writing differ significantly from low speeds associated with labeling.

In U.S. Pat. No. 6,270,177 B1 issued on Aug. 7, 2001 to King et al, a printing system is described having a printer unit with an ink jet print head, a detachable print roll cartridge for printing on paper. Although the printing unit may be inserted into an empty drive bay of a computer, there is no provision for printing directly on discs. Since even at best, CD printing is a separate process from "burning" or writing the CD conducted on a separate device, the additional step leads to clutter on the user desktop as with a typical means such as, for example, a CD Stomper and label sheets. In addition, printer alignment and associated adjustment of printer settings with each label sheet used further complicates the conventional labeling process. Thus, the process of "creating" a CD or DVD is typically broken up into two general steps: the "inside" process of "burning" or writing the data to the disc, and the "outside" process of printing and affixing a label on the disc or alternatively printing directly onto the disc since some CDs may have a textured upper surface enabling text or image printing with either laser or inkjet printing technologies. Conventional disc printing remains however a separate, bothersome process requiring additional equipment to take up desktop or shelf space. The conventional process forces users to engage in additional steps such as removing standard paper from their printer and replacing it with label paper every time the creation of a labeled CD/DVD is desired, which process represents an intrusion on the desktop arrangement and may waste time.

An additional issue related to printing on a CD/DVD is the printing media itself. One disadvantage associated with conventional CD/DVD labeling media is the potential smearing of ink in ink jet printing schemes, and toner smearing for laser related printing. A solution to the above-mentioned problems involves printing on a separate label which may then be attached to the CD/DVD upon removal of both the CD/DVD media from the drive and the printed label from the printing mechanism requiring additional steps. If a change in label content is desired, a new label must be printed and the old label removed since accumulation of labels could lead to interference with drive rotation mechanisms. Thus it is apparent that many conventional label printing methods and devices fall short of providing convenient label printing on CD/DVD media.

Consequently, it would be desirable to provide a way to integrate CD/DVD media label printing with the media "burning" or writing process, so that the operation of "creating a CD" may be completely performed within the same device. It would further be desirable to provide media label printing which could make use of conventional printing methods, e.g. ink, toner, or the like, and also go beyond the use inks or toners.

SUMMARY OF THE INVENTION

Accordingly, the present invention is directed to a drive, preferably an internal drive, for optical media data storage reading and writing having an internal CD/DVD labeling capability, without the need for media removal.

In one embodiment, a drive is provided which is capable of printing a label on a unit of optical media, e.g. an optical disc such as a CD or DVD. The drive of the present invention preferably includes a chassis drive unit, e.g. a frame including the motor drive mechanism, spindle and other features typically associated with a drive such as head support mechanisms, enclosures, connectors, and the like. The drive may further include a transport mechanism coupled to the chassis drive unit capable of accepting the unit of optical media and positioning the unit, for example with a motor drive system, within the drive and placing it in an operational position such as in proximity to heads. A first head, such as a write and/or read head, may be coupled to the chassis drive unit and may be capable of optically communicating with the unit of optical media on a first side. A second label printing head may be coupled to the chassis drive unit and may be capable of applying a visual label associated with the unit of optical media on a second side thereof. It should be noted that the first and the second heads are capable of optically communicating and applying of the visual label respectively while the unit of optical media is positioned within the drive in the operational position. Accordingly, label printing and data reading and writing may be accomplished without media removal. The inventive drive's first head may include an optical read-only head or an optical read-write head, while the second head may include, but is not limited to: a fixed print head, a movable print head, a thermal print head, an ink jet print head, or a laser print head. It should be noted that in accordance with various alternative exemplary embodiments, the unit of optical media is capable of being equipped with an electronic labeling device. The second head is capable of communicating with the electronic labeling device when the unit is accepted within the transport mechanism in the operational position through one or more electrical contacts, or through a wireless interface.

In accordance with another embodiment of the present invention, a circular film is capable of being bonded to a unit of optical media. The circular film preferably includes a bonding region where the film may be bonded to a unit of optical media such as an optical disc, CD/DVD or the like, and may further include an addressable element region coupled to the bonding region, e.g. embedded within a film layer associated with the circular film. The addressable element region preferably contains one or more addressable elements capable of being addressed by a head and thereby providing a visual display when addressed. The addressable elements may include display elements such as liquid crystal elements and may further include one or more contacts. The addressable elements are thus capable of being addressed by electrical contact between the contacts and a contact head. Alternatively, the addressable elements may include one or more wireless receivers associated therewith capable of being addressed through a wireless interface with a wireless head.

In accordance with still another embodiment of the present invention, an article of manufacture is provided which is capable of being applied to a unit of optical media. The article of manufacture may include a circular film with a bonding region, e.g. to bond to the optical media, and an addressable element region coupled to the bonding region and containing one or more addressable elements. The addressable elements may be capable of being addressed by a head and thereby providing a visual display when addressed. The circular film may further include a contact region at an edge thereof wherein the addressable elements are addressable through contact with one or more corresponding row contacts and one or more corresponding column contacts in the contact region by a contact head. The addressable elements may further be addressable through a wireless interface with one or more receivers associated with the one or more addressable elements and a wireless head.

In accordance with still another embodiment of the present invention, a mechanism is provided which is capable of printing a label on a unit of optical media, such as an optical disc, CD, DVD or the like. The mechanism preferably includes a first head, such as a write and/or read head, capable of optically communicating with the unit of optical media on a first side. A second label printing head may be coupled to a least a portion of the first head, e.g. through a chassis or frame piece or the like, and may be capable of applying a visual label associated with the media on a second side. It should be noted that in accordance with the present invention, the first head and the second label printing head are capable of optically communicating and applying the visual label, respectively while the unit of optical media is positioned within the drive in an operational position. In accordance with various exemplary embodiments, the first head may include an optical read-only head or an optical read-write head. The second label printing head may include but is not limited to: a fixed print head, a movable print head, a thermal print head, an ink jet print head, a laser print head, or the like. Alternatively, an electronic labeling device may be provided capable of being bonded with the optical media. In such an instance, the second label printing head is preferably capable of communicating with the electronic labeling device when the media is in the operational position through one or more electrical contacts or, alternatively, through a wireless interface.

In accordance with still another exemplary embodiment of the present invention, a computer system is provided capable of printing a label on a unit of optical media with a single insertion thereof within the computer system. Accordingly, the computer system preferably includes a processor; and an optical drive coupled to the processor, e.g. having both a data write and/or read capability and a label printing capability. The optical drive preferably includes a first head capable of optically communicating with the optical media on a first side thereof, and a second label printing head coupled to a least a portion of the first head, e.g. through a frame member or chassis. The second label printing head is preferably capable of applying a visual label associated with the unit of optical media on a second side thereof. It should be noted that the first head and the second label printing head are capable of optically communicating and applying the visual label, respectively, while the optical media is positioned within the optical drive in an operational position. In accordance with various exemplary embodiments, the first head preferably includes an optical read-only head or optical read-write head. The second head preferably includes but is not limited to: a fixed print head, a movable print head, a thermal print head, an ink jet print head, or a laser print head. The unit of optical media may further be capable of being equipped with an electronic labeling device. The second head is preferably capable of communicating with the electronic labeling device when the unit is in the operational position through one or more electrical contacts. Alternatively, the second head is capable of communicating with the electronic labeling device through a wireless interface.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

Figure 3A:
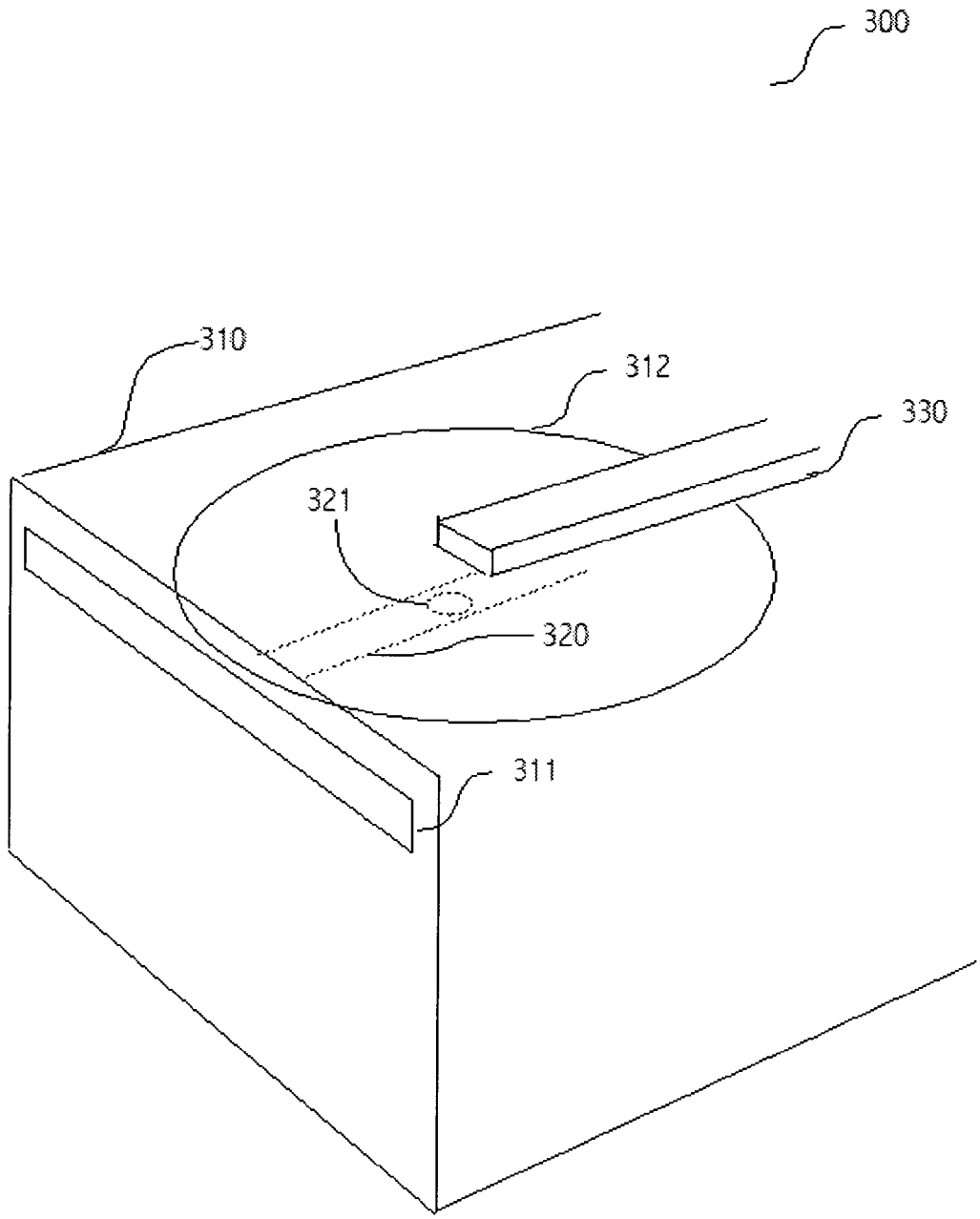
FIG. 3A is a diagram illustrating an exemplary internal CD/DVD read/write drive showing optical read/write heads and an exemplary CD/DVD labeler head in accordance with the present invention.
Figure 3B:
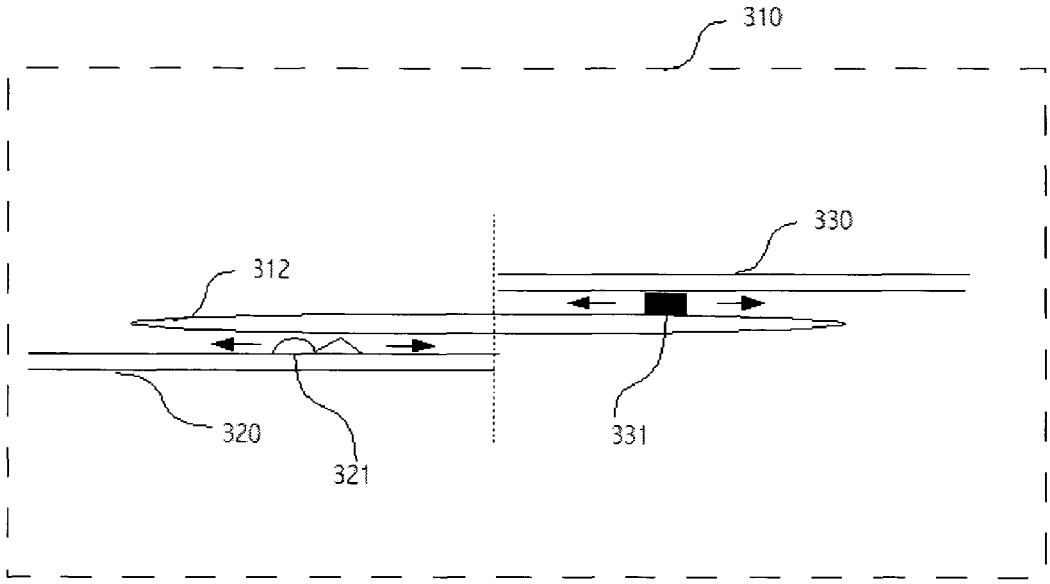
FIG. 3B is a diagram illustrating an exemplary internal CD/DVD read/write drive further illustrating optical read/ write heads and an exemplary CD/DVD labeler moving head in accordance with the present invention.
Figure 3C:
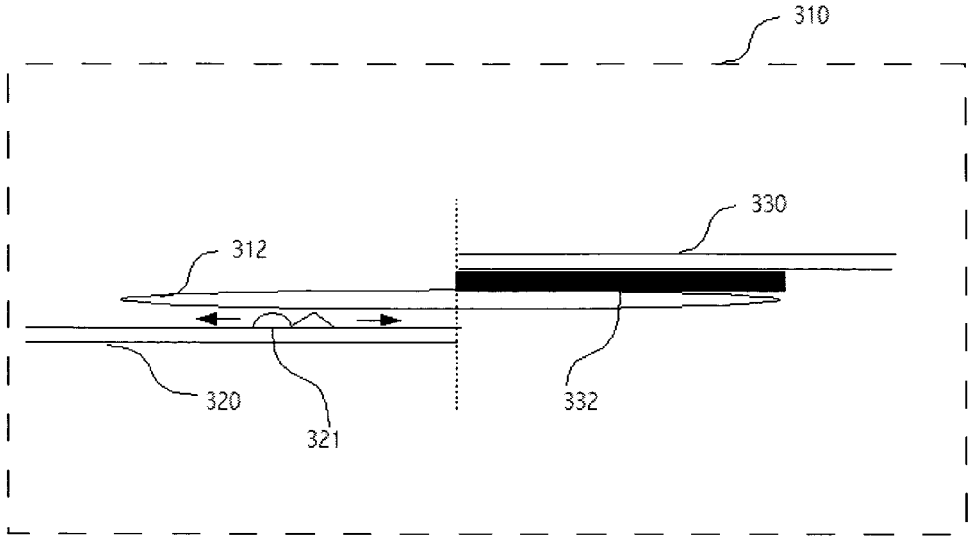
Figure 4A:
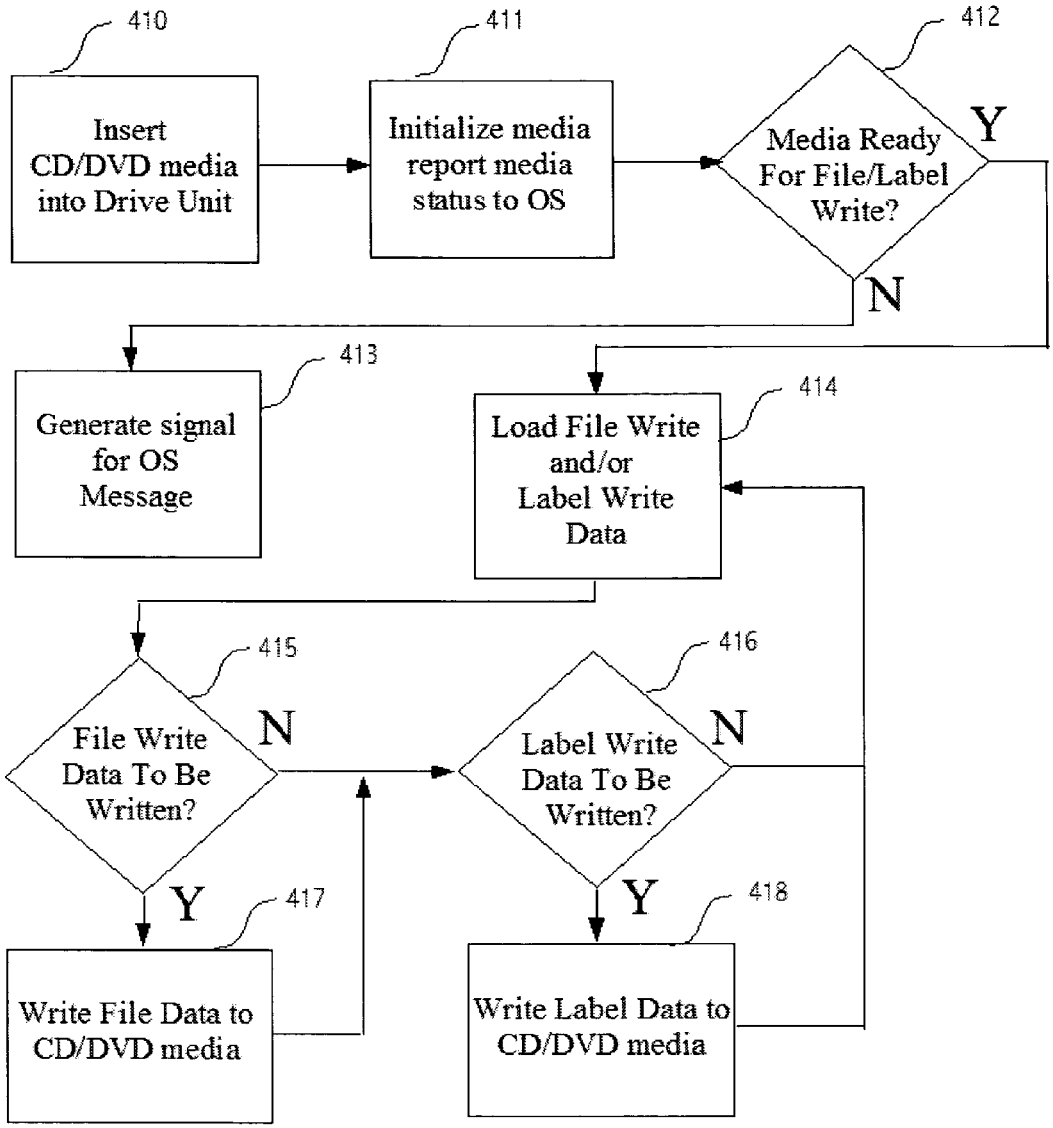
Figure 4B:
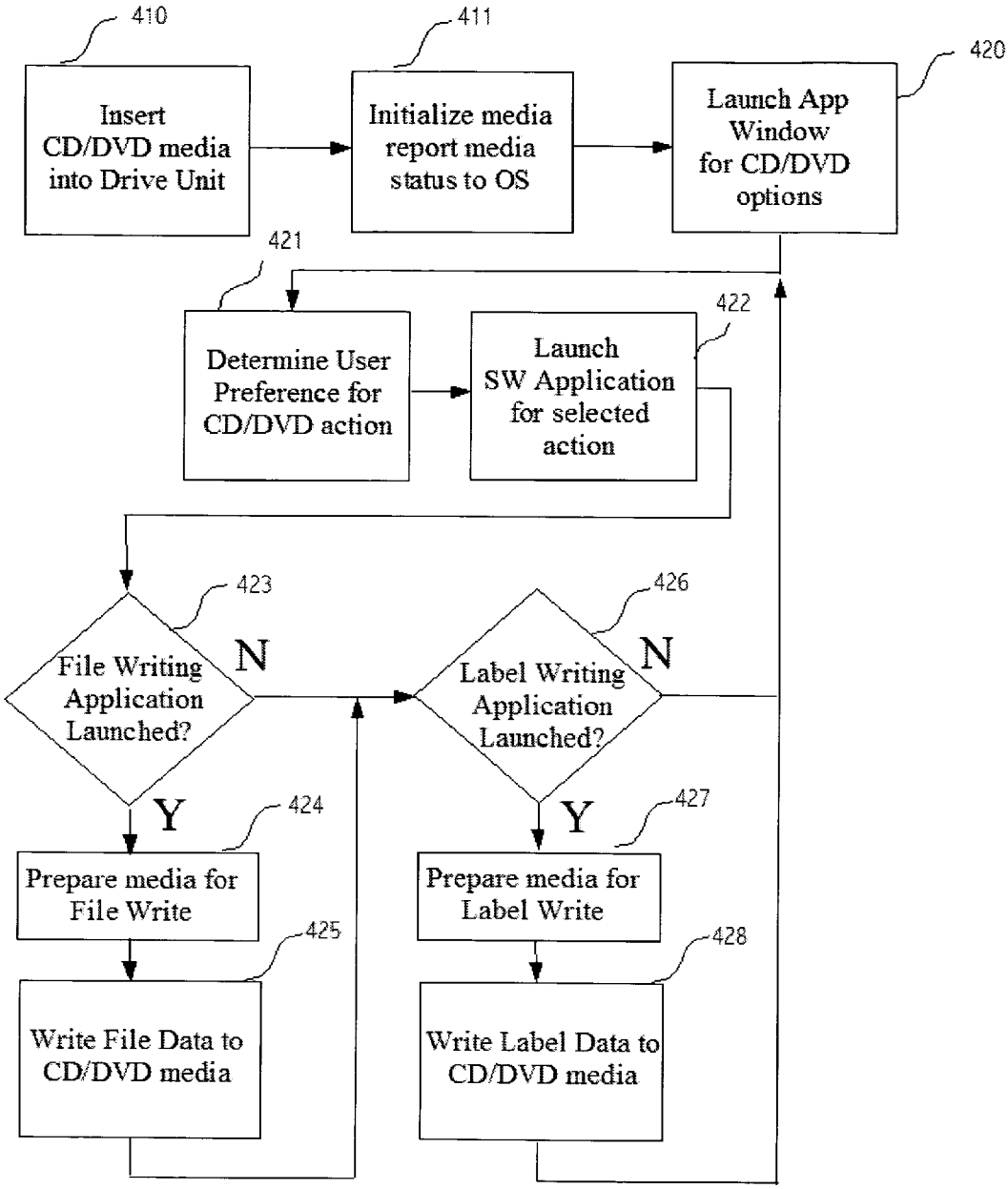
Figure 5A:
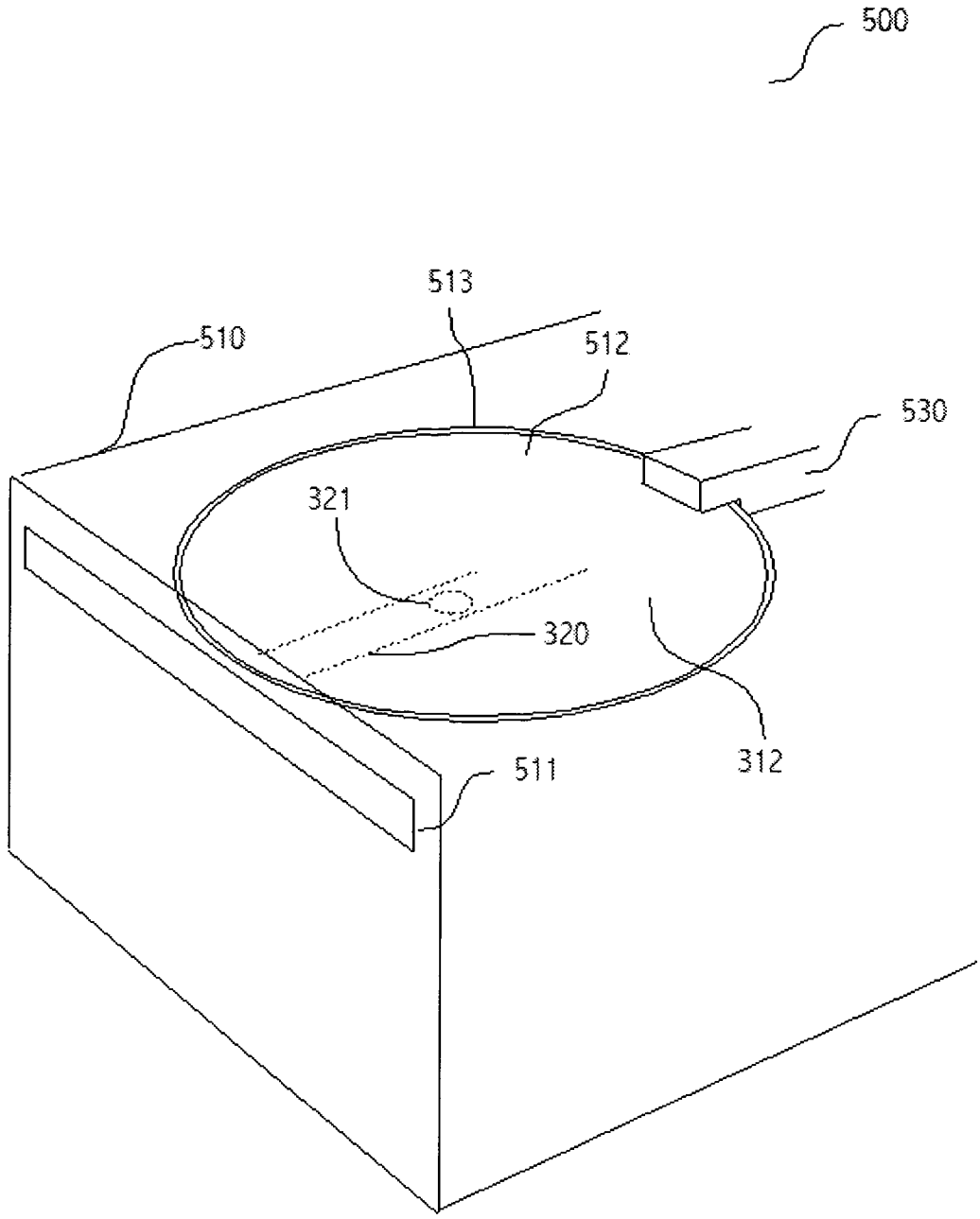
Figure 5B:
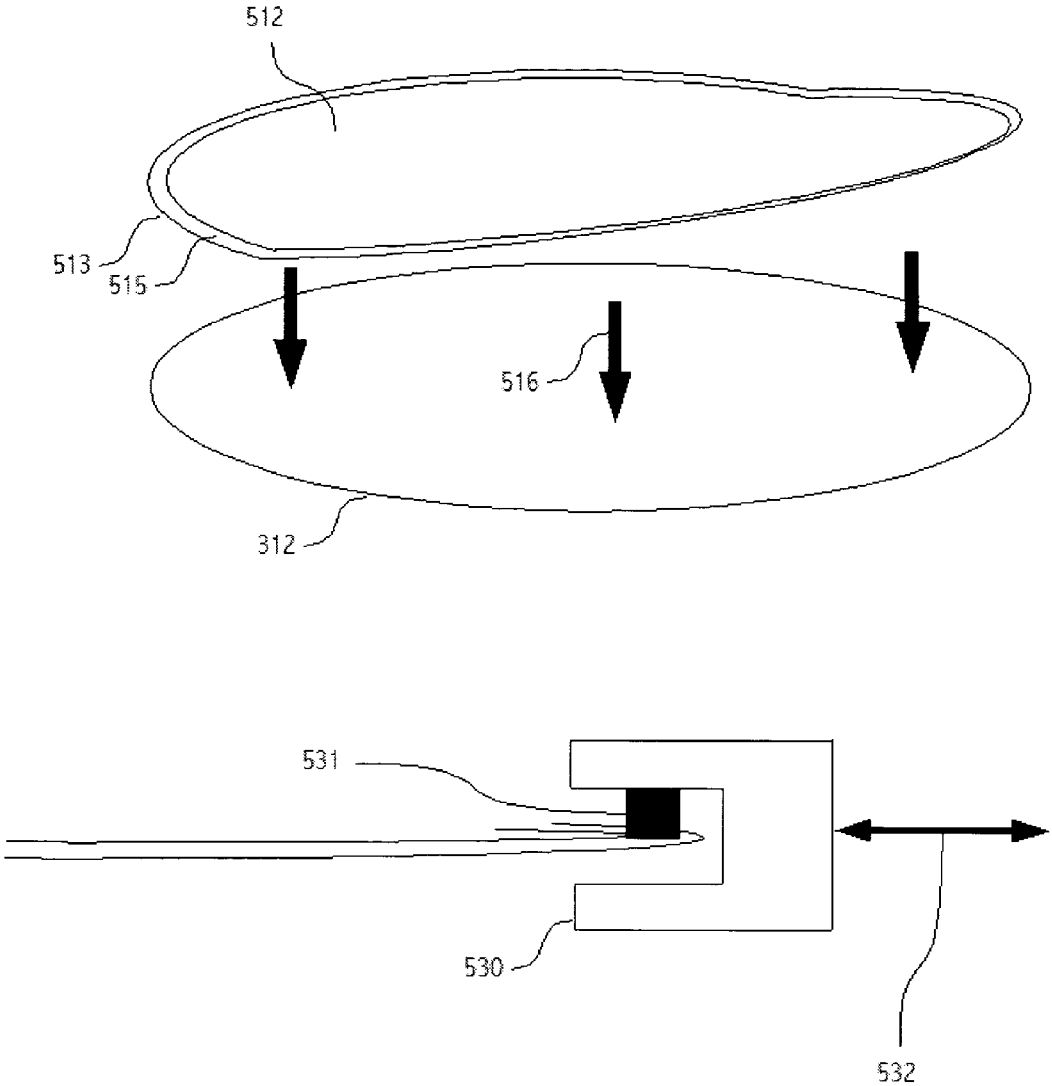
Figure 5C:
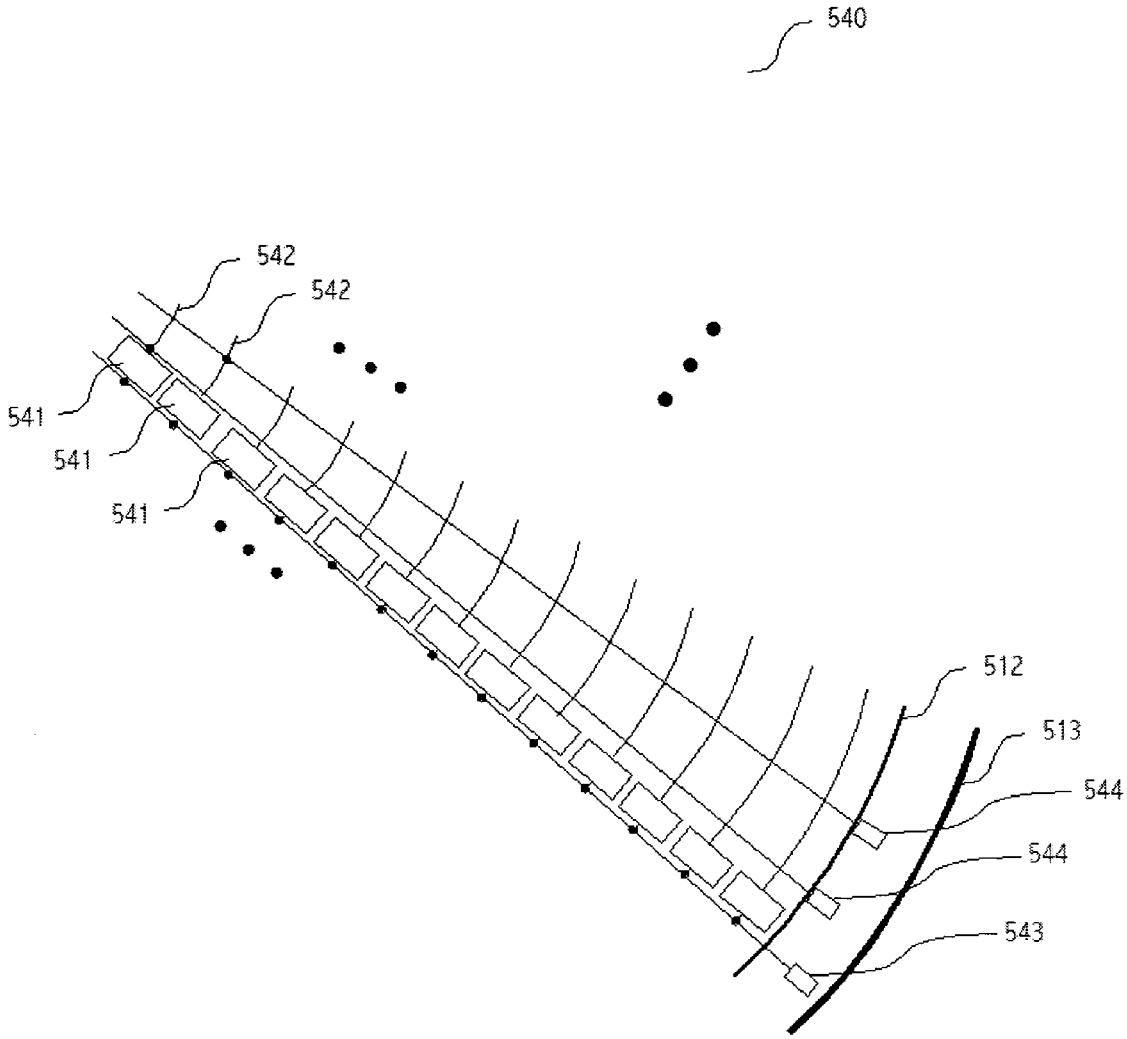

FIG. 3C is a diagram illustrating an exemplary internal CD/DVD read/write drive further illustrating optical read/write heads and an exemplary CD/DVD labeler stationary head in accordance with the present invention;

FIG. 4A is a flow chart illustrating exemplary low-level steps associated with the use of an exemplary CD/DVD labeler head in accordance with the present invention;

FIG. 4B is a flow chart illustrating exemplary high-level steps associated with the use of an exemplary CD/DVD labeler head in accordance with the present invention;

FIG. 5A is a diagram illustrating an exemplary internal CD/DVD read/write drive showing optical read/write heads and an exemplary CD/DVD labeler head in accordance with an alternative embodiment of the present invention;

FIG. 5B is a diagram illustrating an exemplary connection scheme for electronic ink cells in accordance with various alternative exemplary embodiments of the present invention; and FIG. 5C is a diagram illustrating an exemplary label with electronic ink and an exemplary CD/DVD labeler head to connect therewith in accordance with various alternative exemplary embodiments of the present invention.

DETAILED DESCRIPTION OF THE INVENTION

The present invention provides a drive for optical media data storage reading and writing having an internal CD/DVD labeling capability, without the need for media removal. In accordance with the present invention a moving or stationary print head using thermal or ink printing may be incorporated with a conventional optical read/write head. Alternatively, an electronic label may be affixed to the optical media and a print head may connect to the electronic label to address, e.g. "write" to individual cells on the label to produce visually readable characters thereon.

Figure 1A:
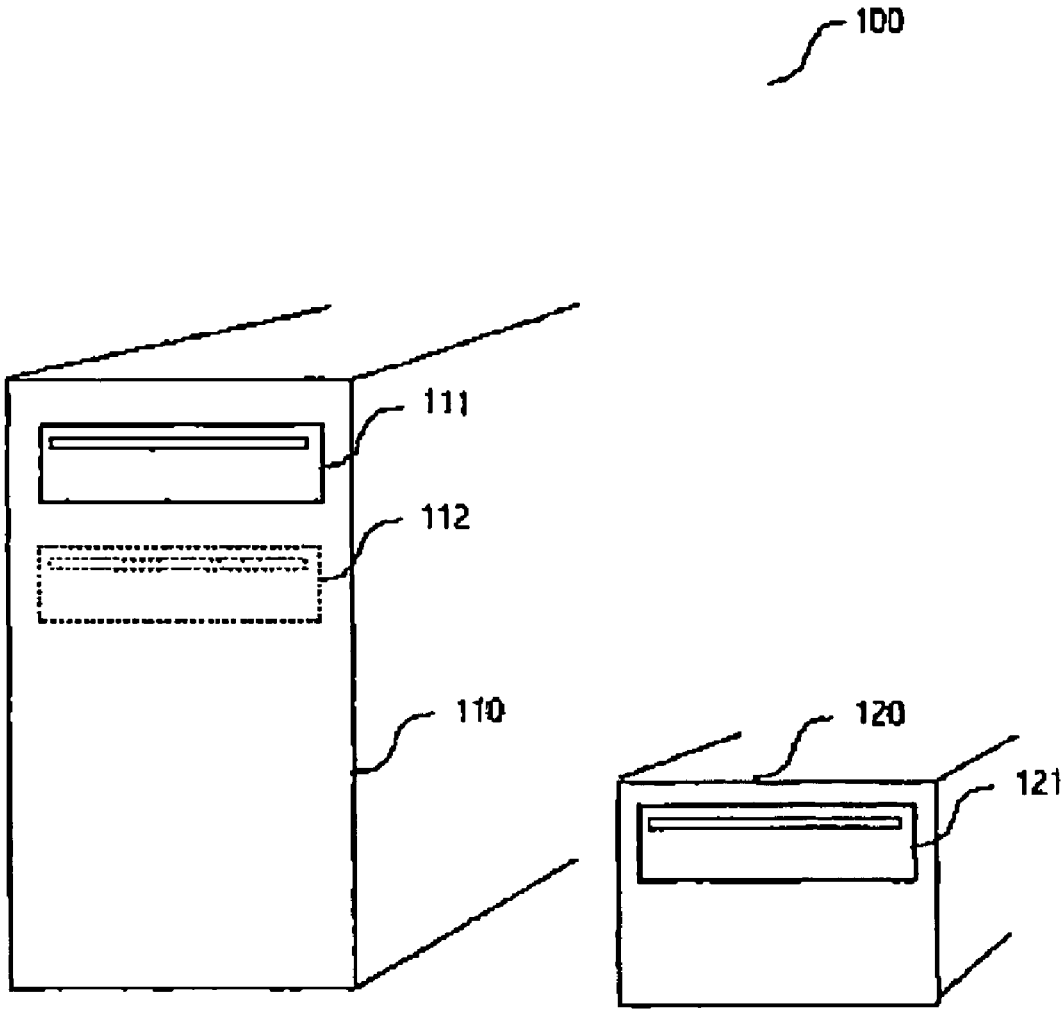
FIG 1A (PRIOR ART)
FIG. 1A is a diagram illustrating an exemplary conventional computer system including both an internal CD/DVD read/write drive and a separate internal CD/DVD labeler and a stand alone CD/DVD labeler.
Figure 1B:
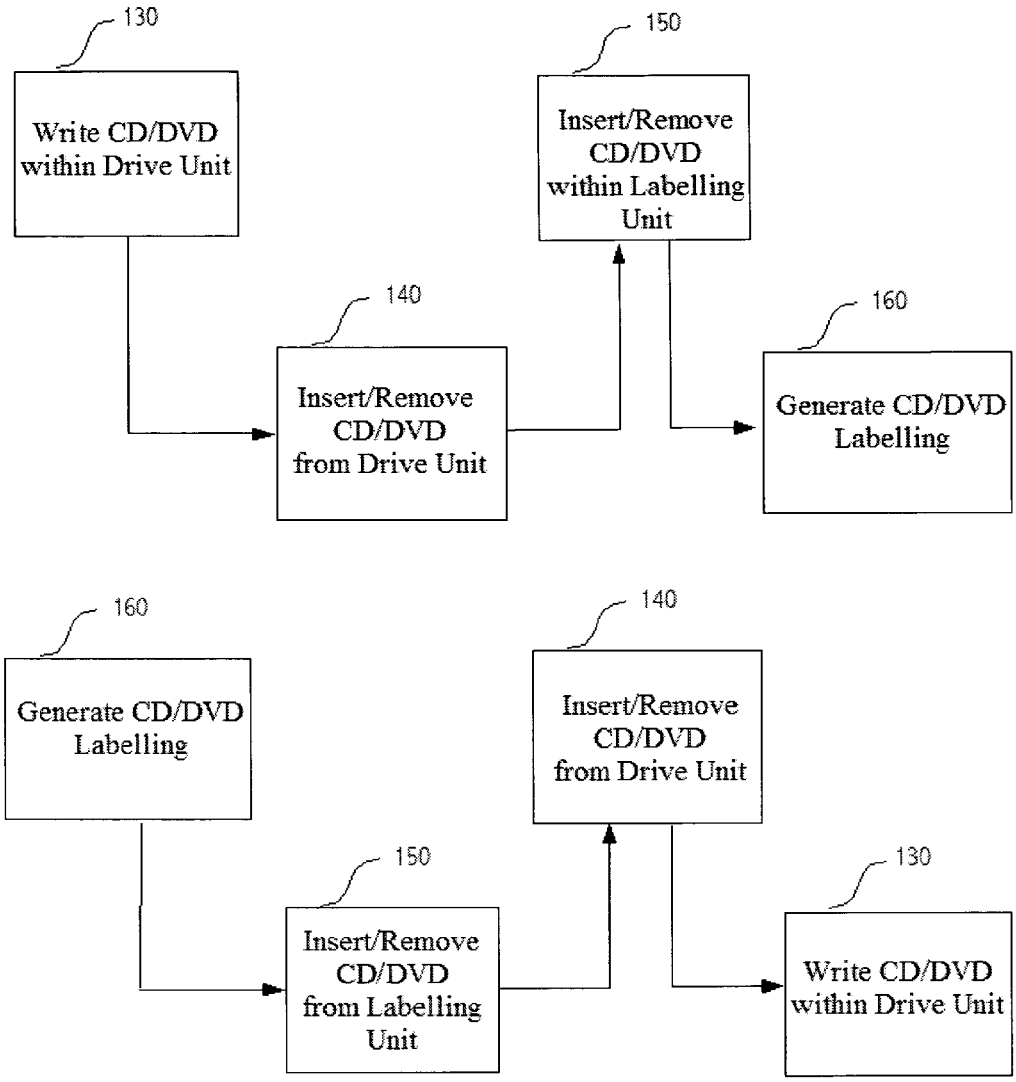
FIG 1B (PRIOR ART)
FIG. 1B is a flow chart illustrating steps associated with writing and labeling a CD/DVD in an exemplary conventional computer system including both an internal CD/DVD read/write drive and a separate internal CD/DVD labeler and/or a stand alone CD/DVD labeler.

As can be seen from FIG. 1A in scenario 100, label writing capabilities can be provided in, for example, desktop tower 110 as drive 111 which may be inserted as a peripheral in addition to other peripherals such as optical drive 112. Alternatively, label writing capabilities may be provided in stand alone system 120 having labeler 121. As described above, certain disadvantages are attendant in either circumstance. The primary problem with a conventional system as is better illustrated in FIG. 1B, is associated with the need for removal of the CD/DVD from a data storage reading and/or writing device to place it in a separate device sometimes remote from the reading or writing system. During a typical session, a CD/DVD may be, for example, written as in step 130 while within drive unit such as optical drive 112. The CD/DVD may then be removed as in step 140 from optical drive 112 and inserted as in step 150 into labeling unit where a label may be generated as in step 160. The process may also be reversed as also shown in FIG. 1B where the label is generated first as in step 160, the CD/DVD removed from the labeling unit as in step 150, CD/DVD inserted into a drive unit such as optical drive 112 as in step 140, and the CD/DVD read or written therewithin. Regardless of what is desired in terms of label writing or data reading or writing it can be seen that steps 140 and 150 are inseparable, e.g. media must be removed from one drive and placed in another to complete a media management task. It is clearly preferable and advantageous to allow for label printing and data reading and writing without the necessity of the additional steps associated with media removal and re-insertion into separate drives. It should be noted that although reference is made to a CD/DVD, the present invention applies to any unit, e.g. disc or the like, of optical media. In alternative embodiments, the present invention is practiced with other medias and storage components, including conventional media environments, e.g. 3.5' floppy disks or other diskette formats, VCR tapes, DVDs, backup digital tapes, or the like.

Figure 2A:
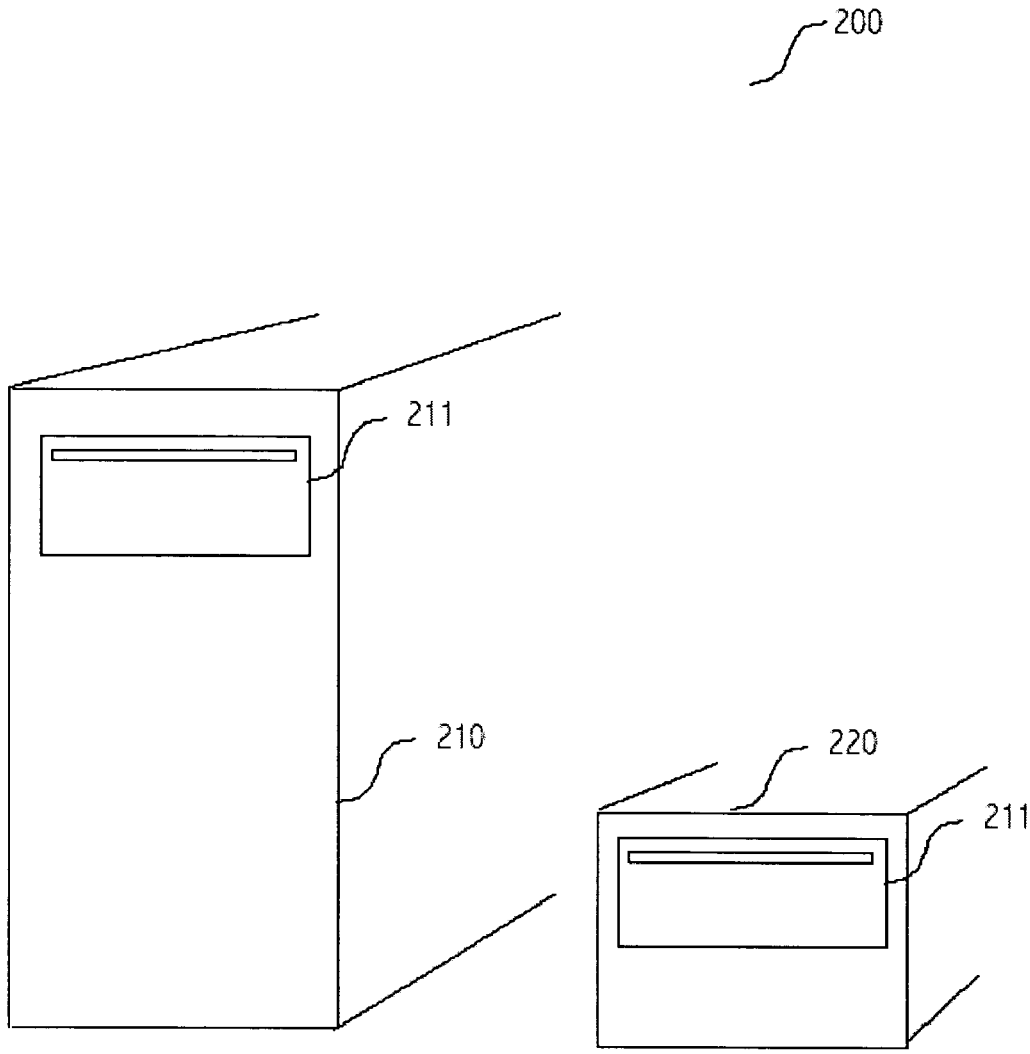
FIG. 2A is a diagram illustrating a computer system including an exemplary internal CD/DVD read/write drive having a CD/DVD labeler in accordance with the present invention.
Figure 2B:
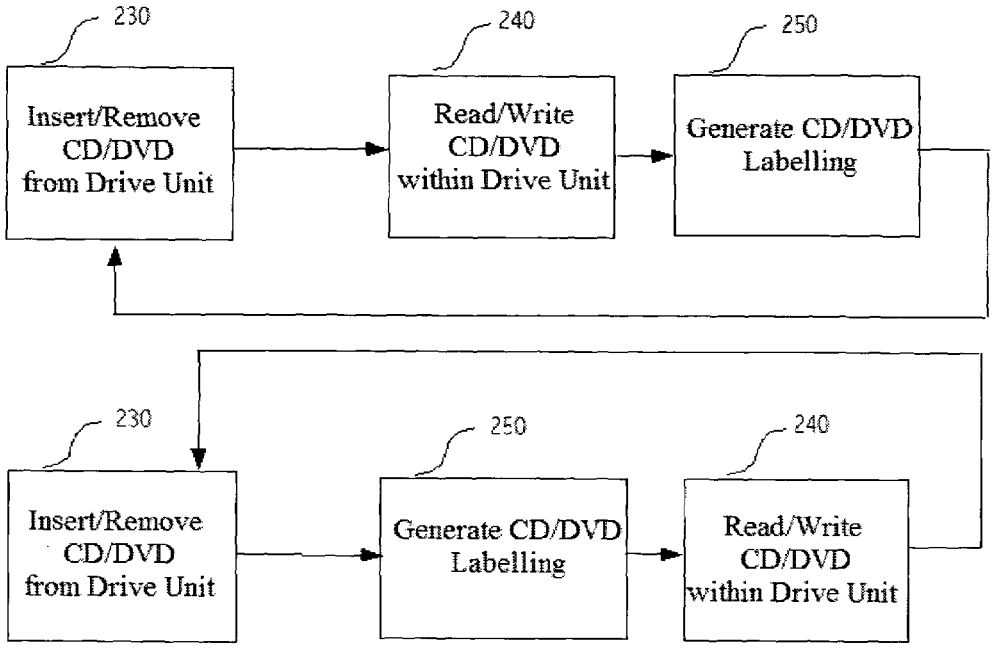
FIG. 2B is a flow chart illustrating exemplary steps associated with writing and labeling a CD/DVD in the same drive in accordance with the present invention.

Thus in accordance with various exemplary embodiments and alternative exemplary embodiments of the present invention, drive 211 is provided including a label printer and a data reading and writing capability is shown in FIG. 2A in scenario 200. It should be noted that the label printer and read and/or write head may be coupled to a chassis drive unit (not shown) housing, for example, a single transport mechanism the drive motor, servos, and the like, as would be appreciated by one of skill in the art. A single transport mechanism is all that is required since a unit of optical media may be inserted once for both label writing and data writing on the media. Desktop tower 210 may be provided with inventive drive 211 obviating the need for an additional optical drive mechanism for data reading and writing or the need for a separate media labeler. It will be appreciated that drive 211 in accordance with alternative embodiments of the present invention may be provided as stand alone unit 220. Whether provided in stand alone unit 220 or in desktop tower 210, drive 211 of the present invention simplifies media management as can be seen from FIG. 2B. As in step 230, a CD/DVD may be inserted into a single transport mechanism associated with drive 211, reading or writing may be conducted as in step 240 and labeling generated in step 250. Alternatively, labeling may be generated first in step 250 before reading or writing as in step 240, or insertion as in step 230. It can easily be seen that whether data reading or writing, label generating or inserting removing media, the steps relate to each other in the same linear sequence, e.g. step 230, 240, 250, 230; or 230, 250, 240, 230. It will further be appreciated that in some instances of media management, a label alone may be generated. If a media label has already been printed, data reading or writing may be all that is desired for a particular media management session. It will further be appreciated that in accordance with various alternative exemplary embodiments of the present invention, the label printer may be used in connection with a read only optical head mechanism.

To better appreciate the drive of the present invention, a more detailed view of exemplary scenario 300 is shown in FIG. 3A. Drive 310 may be provided with optical transport mechanism 320 having head 312 which may be a read/write head or a read only head, and further with label printing mechanism 330. CD/DVD or other optical media 312 may be placed within drive 310 through slot 311. FIG. 3B and FIG. 3C better illustrate optical transport mechanism 320 and label printing mechanism 330.

Label printing mechanism 330 is provided with print head 331 which may be an ink-based printing head such as an inkjet or similar technology, a thermal-based print head such as laser or similar technology, or the like, as would be known to one of ordinary skill in the art. In FIG. 3B print head 331 is shown to be a moving head technology and in FIG. 3C, print head 332 is shown as a stationary head technology. It will be appreciated by one of skill in the art that the moving head technology, for example as associated with print head 331, requires a head transport mechanism such that the print head may be positioned along the entire radius of the disc while stationary head technology, for example as associated with print head 332, has printing means spanning the entire radius of the disc.

In order to properly manage operation of the drive in accordance with the present invention, certain basic system operations may be performed by high and/or low level software to manage in particular the transition from reading or writing data to the media or to label the media. It will be appreciated that, in some embodiments, the speed required for data writing and/or reading is different from the relatively slower speed associated with label printing. In other embodiments, label printing is performed at regular read/write speeds. In these embodiments, which utilize precision control, the two operations are combined with reading/writing/label printing being performed simultaneously.

Of particular interest is the step of writing either data to the CD/DVD, or writing labels to the surface of the disk or to an electronic label as will be described in greater detail hereinafter. In step 410 of the flowchart illustrated in FIG. 4A, a unit of optical media, e.g. a media disc may be inserted into the drive unit in the usual fashion, e.g. via an access slot in the front of the drive or a transport mechanism. In either case, the media disc may be accepted into the transport and brought into position within the drive such that the media is in operational position relative to, for example, the data write and/or read head and the label printing head. It should be noted, that in accordance with the present invention, the media may be written to and read and/or printed while in the same operational position. The media may be initialized, that is, information may be read regarding the contents of the media, if any, and the status of the media, e.g. is the media write ready, is the label ready to write, has a label been previously written, or the like.

While the electronic label to be described in greater detail hereinafter may preferably be re-written at will, an ink or thermal label written directly on the surface of the media may typically be written once. Thus it would be desirable to maintain a file, preferably somewhere on the media, indicating the media label write status. The media status may then be reported in step 411 to the Operating System (OS). If test 412 indicates that the media is ready for file and/or label writing, data for file and or label writing may be loaded in step 414, e.g. from a software application or active directory window or the like, otherwise, a signal or the like may be generated in step 413 to the OS so that the appropriate window, message, or the like may be displayed for the user indicating that the media is not ready for file and or label writing and perhaps more detailed information as would be appreciated by one of ordinary skill in the art. If test 415 reveals that file data does exist to be written, it may be written in step 417, if there is no file data or no additional file data to be written, test 416 may be run to reveal whether label data exists to be written and, if so, it may be written in step 418 to the media.

While the above steps indicate an exemplary sequence of low level steps associated with writing data to and labeling a CD/DVD, it is useful to consider the operation of an exemplary higher level software application as is shown in FIG. 4B. Therein, as above, a media disc may be inserted in step 410 and media status determined and reported in step 411. From there, a window could be launched in step 420 to guide a user through various possible options or actions that can be taken associated with the media including media labeling. In step 421, the user's action preference may be determined, and an appropriate software application may be launched in step 422 for managing the detailed operations associated with the particular action preference. If test 423 reveals a file writing application has been launched, media may be prepared in step 424 for writing and then written in step 425, otherwise, if test 426 reveals a label writing application has been launched, then the disc may be prepared for label writing in step 427 and then written in step 428. It will be noted that at the completion of step 428 or the completion of step 425 with no label data to be written, process flow may return and cycle awaiting the detection of subsequent write requests for file data and/or label data wherein the abovementioned steps may be repeated.

In accordance with various alternative exemplary embodiments, labels may be written using an electronic labeling device or "electronic ink" which may be bonded, glued, attached, applied or otherwise associated in a manner known in the art with a unit of optical media as illustrated in FIG. 5A in scenario 500. Labeling may be provided in drive 510 for media 312 by way of film 512 with addressable elements thereon which film 512 may be placed on the surface of media 312 either during the manufacturing process thereof or thereafter. Film 512 may be provided with edge contacts 513 readable once inserted into slot 511, by a series of corresponding contacts disposed within head unit 530 as will be described in greater detail hereinafter. In accordance with other embodiments, the addressable elements used in "electronic ink" technology may be embedded within, or adhered directly to, the media 312 itself, rather than using film 512 with addressable media. It should be noted that, as in other embodiments, drive 510 may be equipped with optical transport 320 with head 321 which may be a read-write head or a read only head. To better understand film 512 in accordance with the present invention, reference may be made to FIG. 5B. It is apparent that film 512 may have edge 513, and contact area 515. Attachment of film 512 to disc 312 may be made with attachment method 516 which may include thermal bonding, glue bonding, static bonding, adhesive, adhesiveless, or other methods known to those skilled in the art. Disc 312 with film 512 applied thereon may be placed in a transport mechanism associated with the drive and brought into an operational position in proximity with head unit 530 wherein head contacts 531 may come into contact with element contacts associated with writing on film 512 as will be described in greater detail herein below.

A more detailed view of exemplary elements of film 512 are shown in FIG. 5C in scenario 540. It can be seen that film 512 includes a series of addressable elements 541 which could be, for example, liquid crystal elements, or other elements which respond to electrical stimulus by being in a clear or visibly non-clear optical state. By connecting to column contacts 543 and row contacts 544 associated with a particular element 541, data corresponding to the desired character or fill pattern for the particular element 541 may be communicated to form a visible label. It should be noted that elements 541 may correspond to individual character elements which may be written to with data corresponding to the character which is desired to be displayed. Alternatively, each element 541 may be pixel-like in nature where each element 541 is either clear or visible if addressed/not addressed and may be part of a larger array which may be used to form visible patterns or characters making up a visible label based on the individual on-off settings of elements 541. It will be appreciated that although only one column of addressable elements is shown, many more are present over film 512. It will further be appreciated that although elements 541 are shown as electronically addressable through contacts, it may be preferable to address elements electronically through a wireless interface, e.g.

either through wireless coupling, including capacitive coupling to contacts or through direct wireless access either to individual elements equipped with small, low power, inexpensive receivers or a single receiver with connections to all elements. In a direct wireless scheme, head unit 530 may preferably include a small wireless transmitter using a proprietary protocol for element addressing and writing and further to "fix" the contents of the elements, e.g. to prevent further writing.

It is believed that the internal CD/DVD label printer and electronic ink of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A drive capable of printing a label on a unit of optical media, the drive comprising:

a chassis drive unit;

a transport mechanism coupled to the drive unit, the transport mechanism capable of accepting the unit of optical media and positioning the unit within the drive in an operational position;

a first head coupled to the chassis drive unit, the first head capable of optically communicating with the unit of optical media on a first side thereof; and a second label printing head coupled to the chassis drive unit, the second label printing head capable of applying a visual label associated with the unit of optical media on a second side thereof;

wherein the first head and the second label printing head are capable of the optically communicating and the applying of the visual label while the unit optical media is positioned within the drive in the operational position; and wherein the unit of optical media is capable of being equipped with an electronic labeling device and wherein the second head is capable of communicating with the electronic labeling device when the unit is accented within the transport mechanism in the operational position.

2. The drive of claim 1, wherein the first head includes an optical read-only head.

3. The drive of claim 1, the first head includes an optical read-write head.

4. The drive of claim 1, wherein the second label printing head includes a fixed print head.

5. The drive of claim 1, wherein the second label printing head includes a movable print head.

6. The drive of claim 1, wherein the second label printing head is capable of communicating with the electronic labeling device through one or more electrical contacts.

7. The drive of claim 1, wherein the second label printing head is capable of communicating with the electronic labeling device through a wireless interface.

8. A mechanism capable of printing a label on a unit of optical media, the mechanism comprising:

a first head capable of optically communicating with the unit of optical media on a first side thereof; and a second label printing head coupled to a least a portion of the first head, the second label printing head capable of applying a visual label associated with the unit of optical media on a second side thereof;

wherein the first head and the second label printing head are capable of the optically communicating and the applying of the visual label while the unit of optical media is positioned within the drive in an operational position;

wherein the unit of optical media is capable of being equipped with an electronic labeling device and wherein the second head is capable of communicating with the electronic labeling device when the unit is in the operational position.

9. The mechanism of claim 8, wherein the first head includes an optical read-only head.

10. The mechanism of claim 8, wherein the first head includes an optical read-write head.

11. The mechanism of claim 8, wherein the second label printing head includes a fixed print head.

12. The mechanism of claim 8, wherein the second label printing head includes a movable print head.

13. The mechanism of claim 8, wherein the second label printing head is capable of communicating with the electronic labeling device through one or more electrical contacts.

14. The mechanism of claim 8, wherein the second label printing head is capable of communicating with the electronic labeling device through a wireless interface.

15. A computer system capable of printing a label on a unit of optical media with a single insertion of the unit of optical media within the computer system, the computer system comprising:

a processor; and an optical drive coupled to the processor, the optical drive further including:

a first head capable of optically communicating with the unit of optical media on a first side thereof; and a second label printing head coupled to a least a portion of the first head, the second label printing head capable of applying a visual label associated with the unit of optical media on a second side thereof;

wherein the first head and the second label printing head are capable of the optically communicating and the applying of the visual label while the unit of optical media is positioned within the optical drive in an operational position;

wherein the unit of optical media is capable of being equipped with an electronic labeling device and wherein the second head is capable of communicating with the electronic labeling device when the unit is in the operational position.

16. The computer system of claim 15, wherein the first head includes an optical read-only head.

17. The computer system of in 15, wherein the first head includes an optical read-write head.

18. The computer system of claim 15, wherein the second label printing head includes a fixed print head.

19. The computer system of claim 15, wherein the second label printing head includes a movable print head.

20. The computer system of claim 15, wherein the second label printing head is capable of communicating with the electronic labeling device through one or more electrical contacts.

21. The computer system of claim 15, wherein the second label printing head is capable of communicating with the electronic labeling device through a wireless interface.

* * * * *